US010159353B1

(12) United States Patent
Medina-Minick

(10) Patent No.: US 10,159,353 B1
(45) Date of Patent: Dec. 25, 2018

(54) PORTABLE SADDLE SEAT

(71) Applicant: Carmelita Medina-Minick, Albuquerque, NM (US)

(72) Inventor: Carmelita Medina-Minick, Albuquerque, NM (US)

( * ) Notice: Subject to any disclaimer, the term of this patent is extended or adjusted under 35 U.S.C. 154(b) by 77 days.

(21) Appl. No.: 15/361,305

(22) Filed: Nov. 25, 2016

Related U.S. Application Data

(60) Provisional application No. 62/260,091, filed on Nov. 25, 2015.

(51) Int. Cl.
*A47C 9/10* (2006.01)
*A47C 7/62* (2006.01)
*A47C 4/04* (2006.01)

(52) U.S. Cl.
CPC ..... *A47C 9/10* (2013.01); *A47C 4/045* (2013.01); *A47C 7/62* (2013.01)

(58) Field of Classification Search
CPC .. A47C 9/10; A47C 4/045; A47C 4/02; A47C 4/28; A47C 7/62
USPC ..... 297/183.1, 183.3, 183.5, 183.8, 183.9
See application file for complete search history.

(56) References Cited

U.S. PATENT DOCUMENTS 690,122 A * 12/1901 Slagle ..... A45B 5/00 248/155
1,814,497 A 7/1931 Thompson
1,963,835 A * 6/1934 Deland ..... A47C 9/10 297/44
2,484,454 A 10/1949 Heifner
3,066,980 A 12/1962 Clute
4,079,992 A * 3/1978 Thrift ..... A47C 4/52 297/17
4,718,727 A 1/1988 Sheppard
4,945,589 A 8/1990 Carey
5,067,771 A 11/1991 Ellis et al.
5,241,712 A 9/1993 Mahoney
5,333,336 A 8/1994 Langsam
5,419,612 A 5/1995 Rassekhi
5,469,592 A 11/1995 Johnson
5,580,130 A 12/1996 Williams et al.
5,634,685 A 6/1997 Herring
5,658,050 A 8/1997 Lorbiecki
5,697,671 A 12/1997 Shavitz
(Continued)

FOREIGN PATENT DOCUMENTS

RU 149504 1/2015

OTHER PUBLICATIONS

"Salli", http://www.salli.com/en/chairs, 2015.
(Continued)

*Primary Examiner* — Mark R Wendell
(74) *Attorney, Agent, or Firm* — Peacock Law P.C.; Justin R. Jackson; Deborah A. Peacock

(57) ABSTRACT

A portable saddle seat wherein, in one embodiment, the saddle seat can be a stadium seat which can be placed on top of a stadium bleacher. The portable saddle seat can be folding or non-folding and can optionally include a handle formed therein. One or more straps can be attached to the seat to permit a user to easily carry the seat on his or her shoulders or back. In one embodiment, one or more seat cushions can be attached to or disposed on the seat. Optionally, foldable and/or extendable legs can be provided so that the saddle seat can be disposed a distance above a supporting surface.

20 Claims, 21 Drawing Sheets

(56) References Cited

U.S. PATENT DOCUMENTS

| | | | | |
|---|---|---|---|---|
| 5,975,629 | A | 11/1999 | Lorbiecki | |
| 6,012,772 | A | 1/2000 | Conde et al. | |
| 6,276,118 | B1 | 8/2001 | Ilfeld | |
| 6,390,551 | B1 | 5/2002 | Hendrickson | |
| 6,481,792 | B1 | 11/2002 | Goin | |
| 6,502,902 | B1 | 1/2003 | Romero | |
| 6,893,097 | B1 * | 5/2005 | Ebensperger | A47C 9/10 297/16.2 |
| 6,971,715 | B2 | 12/2005 | Hankins | |
| 7,055,907 | B1 | 6/2006 | Tilby | |
| 7,293,827 | B2 * | 11/2007 | Schrader | A45B 3/00 135/66 |
| 7,396,083 | B2 * | 7/2008 | Kasner | A01K 97/00 297/188.09 |
| 7,448,676 | B2 | 11/2008 | Wyner et al. | |
| 7,506,932 | B2 | 3/2009 | Bostrom et al. | |
| 7,594,696 | B2 * | 9/2009 | Girard | A47C 9/025 297/130 |
| 7,631,934 | B2 | 12/2009 | Mac | |
| 7,980,625 | B2 * | 7/2011 | Worthington | A47C 16/00 248/125.8 |
| 8,061,767 | B2 | 11/2011 | Kunzler et al. | |
| 8,297,706 | B2 | 10/2012 | Matthews | |
| 8,469,369 | B1 | 6/2013 | McCarthy et al. | |
| 8,616,651 | B2 | 12/2013 | Matthews | |
| D741,073 | S * | 10/2015 | Keen | D6/349 |
| 9,715,869 | B1 * | 7/2017 | Sorenson | F16M 11/28 |
| 2005/0242630 | A1 * | 11/2005 | Miller | A01K 97/00 297/4 |
| 2011/0162288 | A1 | 7/2011 | Conner | |
| 2011/0198897 | A1 * | 8/2011 | Hosler | A47C 9/025 297/195.11 |
| 2013/0257128 | A1 | 10/2013 | Grace | |
| 2014/0191544 | A1 | 7/2014 | Comber | |
| 2016/0192780 | A1 * | 7/2016 | Sinclair | A47C 4/04 297/183.5 |

OTHER PUBLICATIONS

"The Posture Improving Saddle Seat", http://www.hammacher.com/Product/Default.aspx?sku=79184, 2014.

Cha, "Airbus files patent for saddle seats on planes", http://www.cnn.com/2014/07/17/travel/airbus-saddle-seat-patent/, Jul. 18, 2014.

Girod Medical, "Ecopostural Pony Saddle Stool", https://www.girodmedical.eu/ecopostural-pony-saddle-stool-with-chromium-plated-base-s3660.html#product-collateral, 2012.

Specialized, "Phenom Expert Bicycle Seat", http://cdn.outdoorgearlab.com/reviews/biking/bike-saddle/specialized-phenom-expert, 2016.

* cited by examiner

PORTABLE SADDLE SEAT

CROSS-REFERENCE TO RELATED APPLICATIONS

This application claims priority to and the benefit of the filing of U.S. Provisional Patent Application Ser. No. 62/260,091, entitled "Portable Saddle Seat", filed on Nov. 25, 2015, and the specification thereof is incorporated herein by reference.

BACKGROUND OF THE INVENTION

Field of the Invention (Technical Field)

Embodiments of the present invention relate to a portable saddle seat. In one embodiment, the portable saddle seat can be foldable for ease of portability.

Description of Related Art

Although portable seats have been known for a long time, such seats are often uncomfortable, particularly when a user remains seated for long periods of time. Such seats are typically very basic in their design and thus not very ergonomic. The known portable seats generally feature a fiat bottom which does little to conform to the actual shape of a user.

Folding stadium seats have recently become popular for providing added padding and a back for users who attend sporting events or other events where bleacher-type seating is provided. Such folding stadium seats, however, also feature a very fiat bottom and a flat back which causes a user fatigue and becomes uncomfortable when sitting for extended periods of time. There is thus a present need for a more ergonomically-designed portable seating so that users can experience less fatigue or discomfort while seated for long periods.

BRIEF SUMMARY OF EMBODIMENTS OF THE PRESENT INVENTION

An embodiment of the present invention relates to a portable saddle seat having a top surface having a generally concave shape along a center portion thereof from a front to a back and a generally convex shape from a left side to a right side, and the saddle seat transmitting a weight of a user along an outer bottom edge thereof. The seat can be formed from a single continuous piece of material, One or more paddings and/or seat covers can be disposed on a top of the portable saddle seat. Optionally, at least one handle can also be provided and it can optionally be formed on a back portion of the portable saddle seat. Optionally, the handle can include an opening through the saddle seat near an edge of the saddle seat.

One or more carrying straps can be provided and can be attached to the saddle seat. The one or more carrying straps can be attached to the portable saddle seat such that the portable saddle seat can be transported on a user's back in the same manner as a backpack. Non-slip material can be disposed on a bottom of the portable saddle seat. Optionally, a cup-holder can be provided and it can optionally be removably positionable.

An embodiment of the present invention also relates to a portable saddle seat having a top surface having a generally concave shape along its center from a front to a back and a generally convex shape from a left side to a right side, the seat can include a recessed bottom, and a handle formed into the portable saddle seat by disposing an elongated opening near an edge of the portable saddle seat through which opening a user can insert fingers and grasp the edge of the portable saddle seat. Optionally, a container can be attached to the recessed bottom of the portable saddle seat.

In one embodiment, the portable saddle seat can be formed from a single continuous piece of material, which can optionally be a molded piece of plastic material. Optionally, one or more seat cushions can be disposed on the portable saddle seat. A gap can be disposed in the seat cushion along a top central portion thereof. In one embodiment, a leg portion of the portable saddle seat has a width of less than ⅔ of the overall width of the portable saddle seat.

An embodiment of the present invention also relates to a portable saddle seat having a left seat portion, a right seat portion, the left and right seat portions hingedly connected together, a top seat portion formed by said left and right seat portions when extended to their fully-open configuration and the top seat portion having a generally concave shape along its center from a front to a back and a generally convex shape from a left side to a right side; and a stop spanning between the left and right seat portions.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention, The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
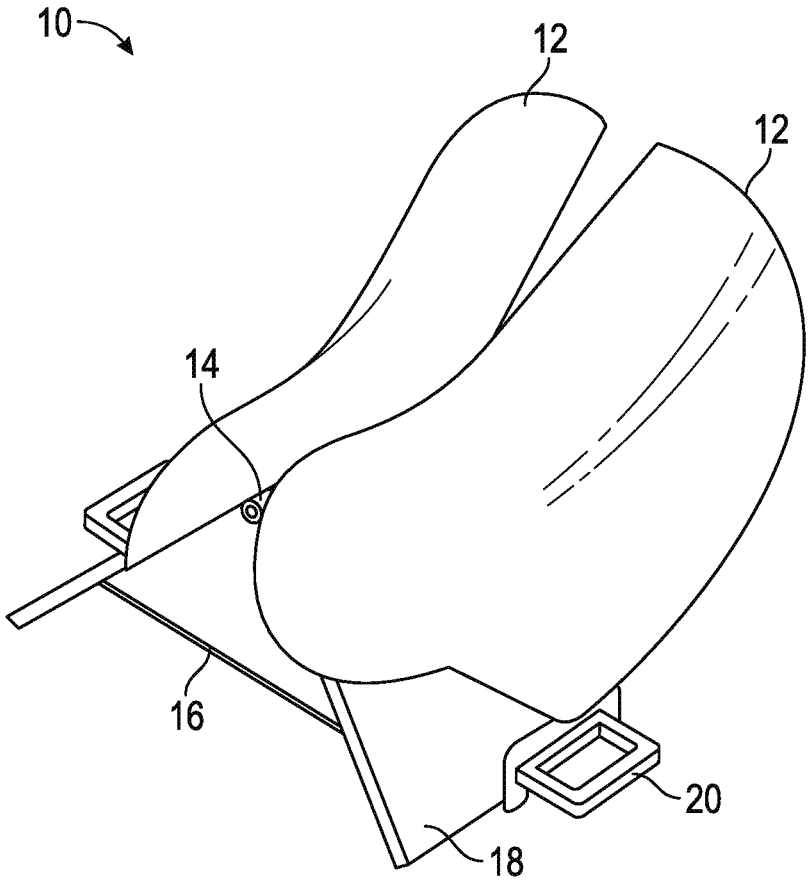
FIGS. 1, 2, 3, and 4 are drawings which illustrate a portable saddle seat in an open position from various perspectives according to an embodiment of the present invention.
Figure 2:
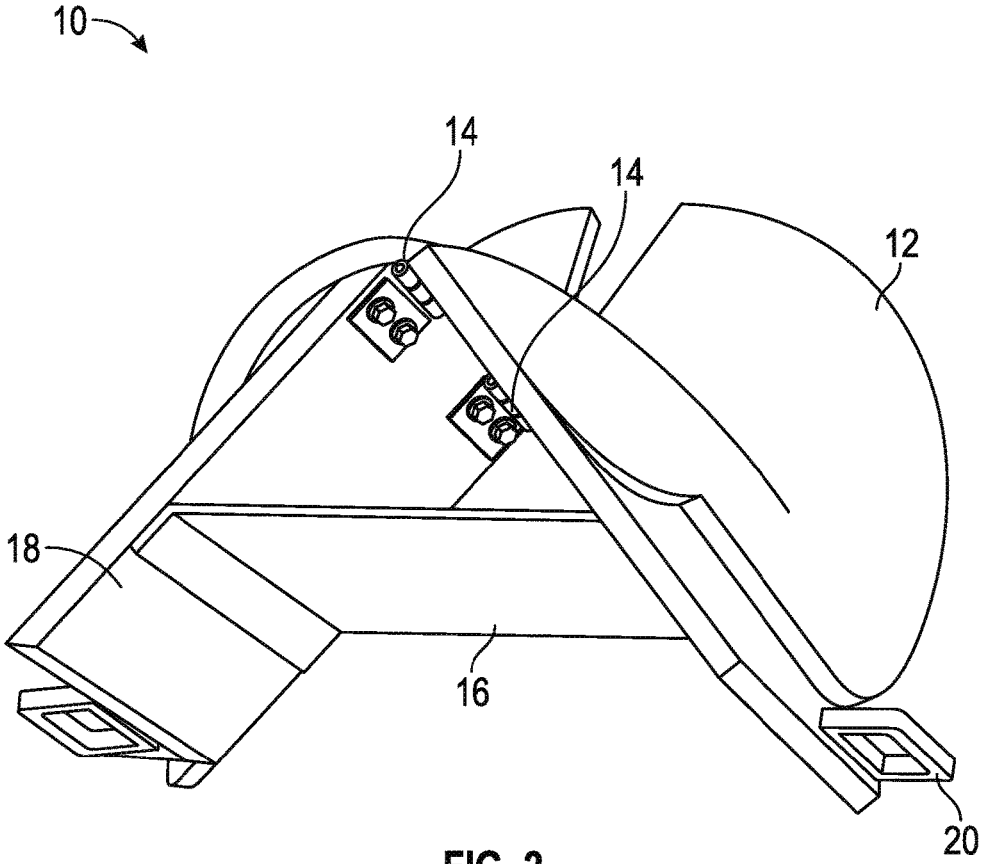
Figure 3:
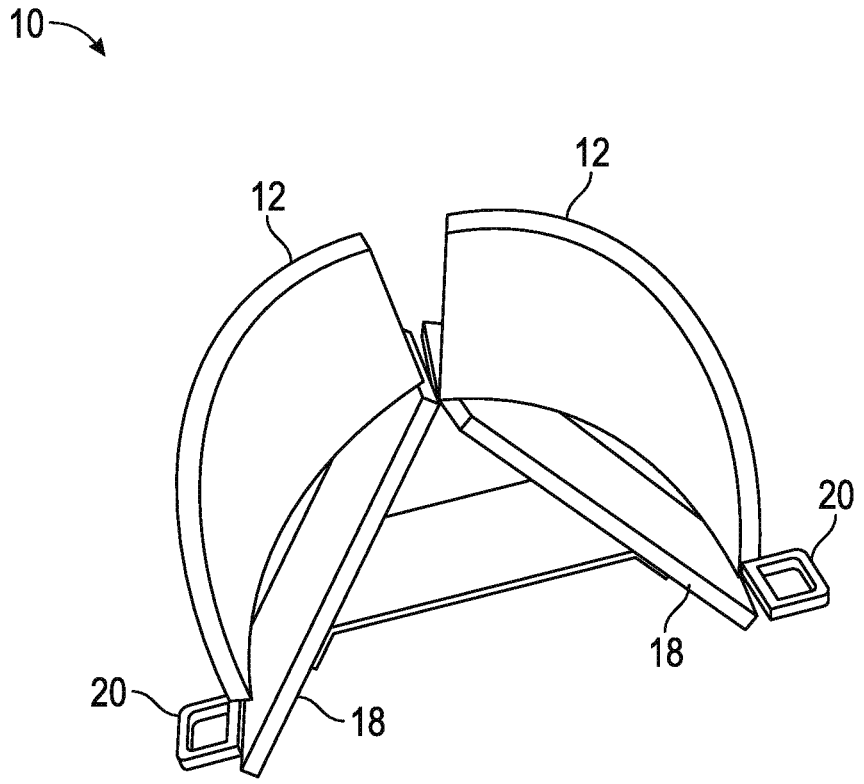
Figure 4:
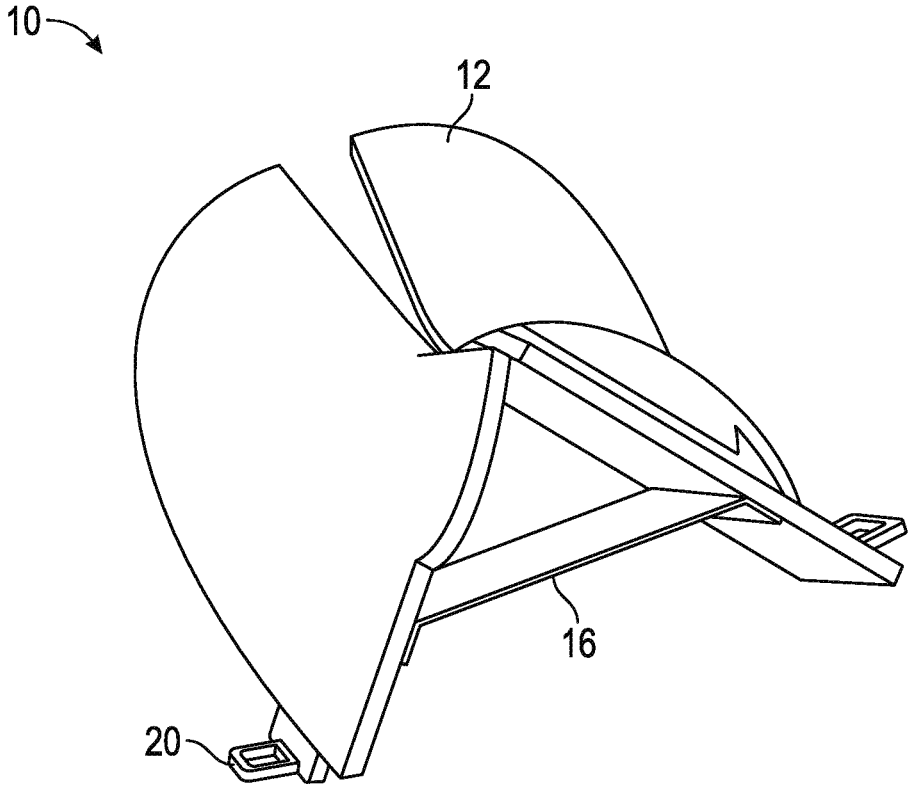
Figure 5:
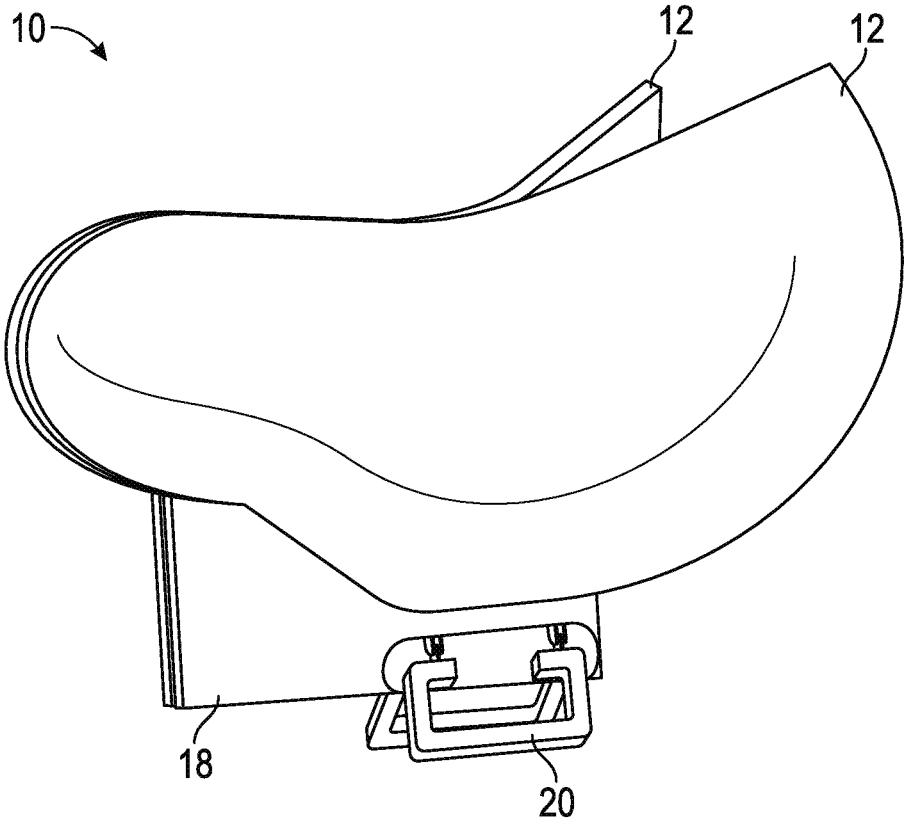
FIGS. 5, 6, and 7 are drawings which illustrate a portable saddle seat in a folded closed position from various perspectives according to an embodiment of the present invention.
Figure 6:
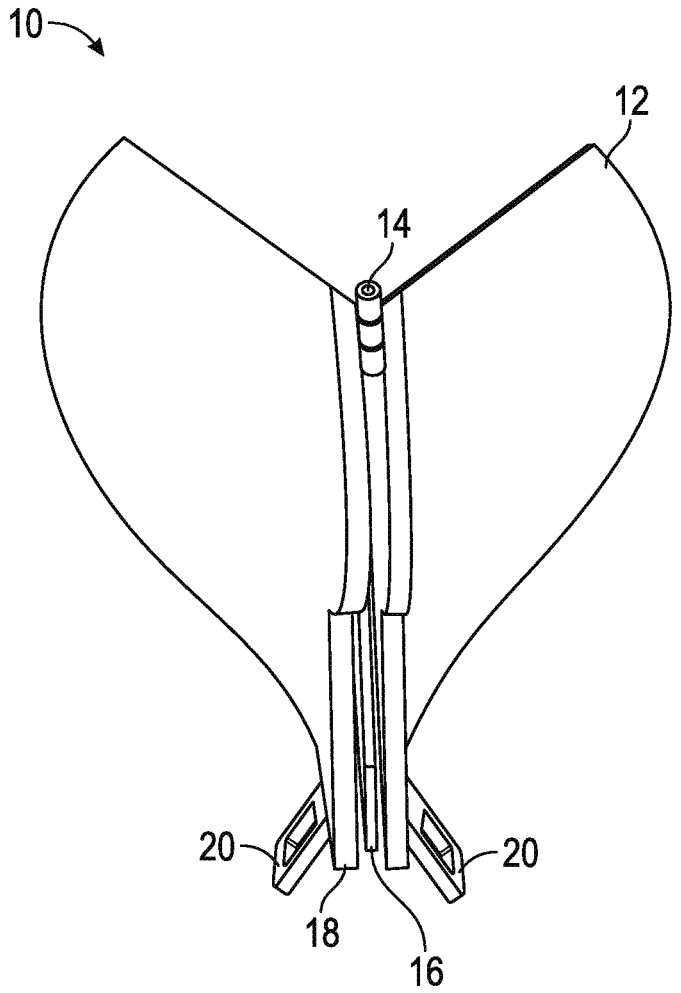
Figure 7:
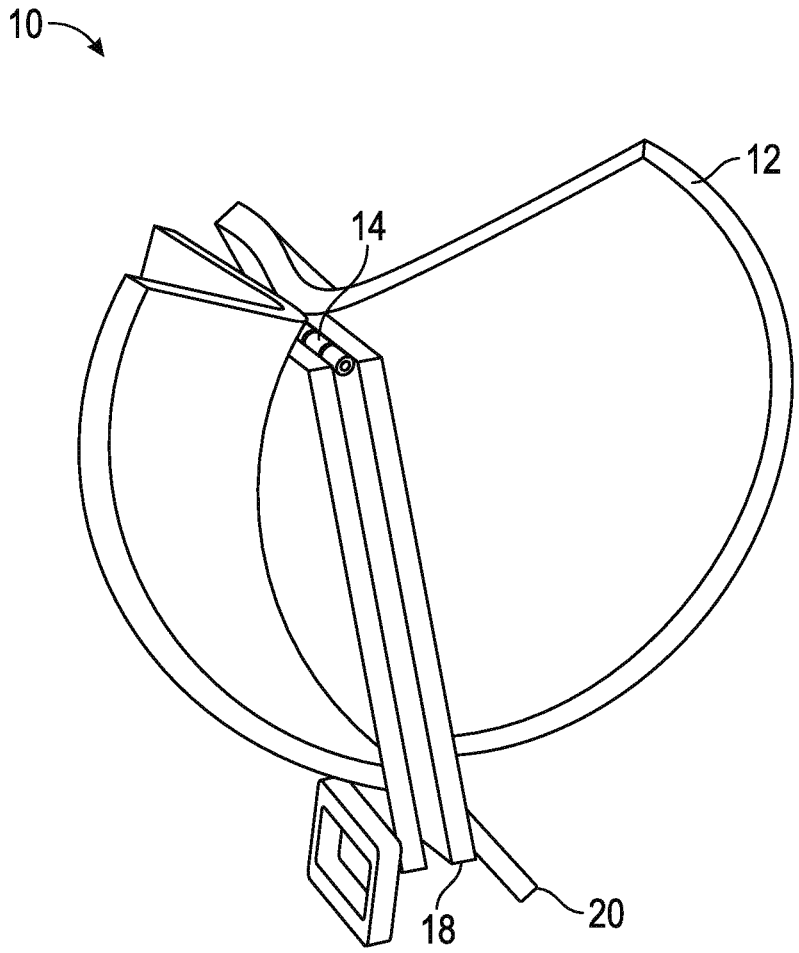

An embodiment of the present invention relates to a portable saddle seat, particularly one which can fold and which can optionally feature extendable legs.

Referring now to the drawings, an embodiment of saddle seat 10 preferably has left and right seat halves 12, one or more hinges 14 and stop 16. Although stop 16 can be connected directly to seat halves 12, in one embodiment seat halves 12 are preferably attached to or otherwise formed onto left and right base plates 18 and stop 16 therefore can be connected between left and right base plates 18. Optionally, one or more handles 20 can be provided to facilitate portability of saddle seat 10.

Figure 8:
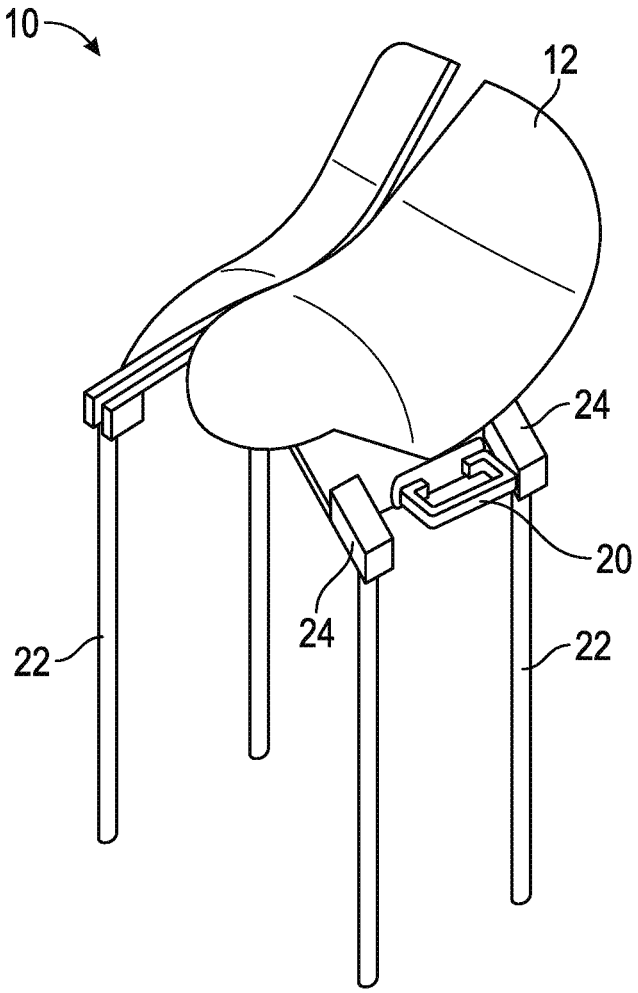
FIGS. 8, 9, and 10 are drawings which illustrate a portable saddle seat with legs from various perspectives according to an embodiment of the present invention.
Figure 9:
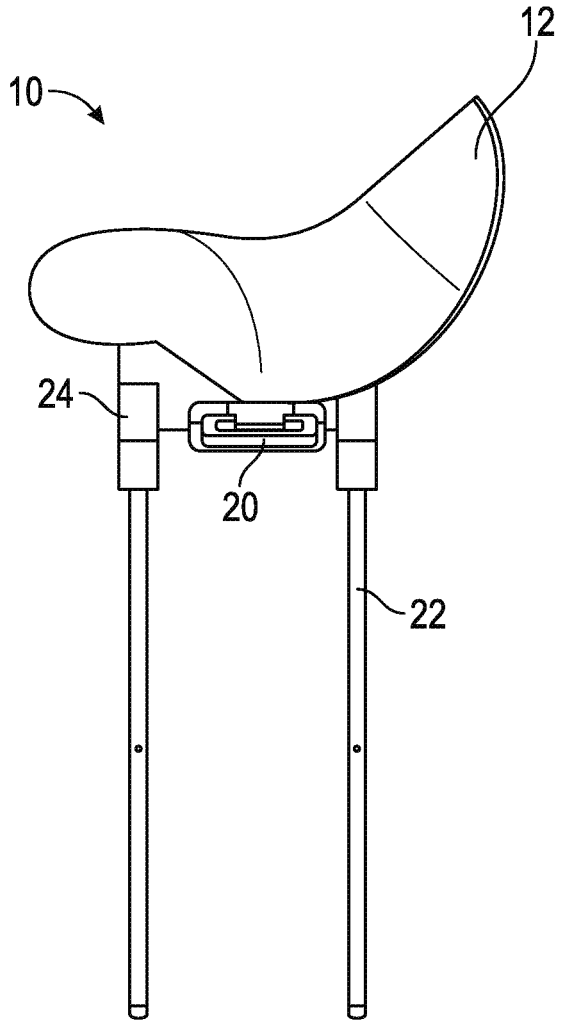
Figure 10:
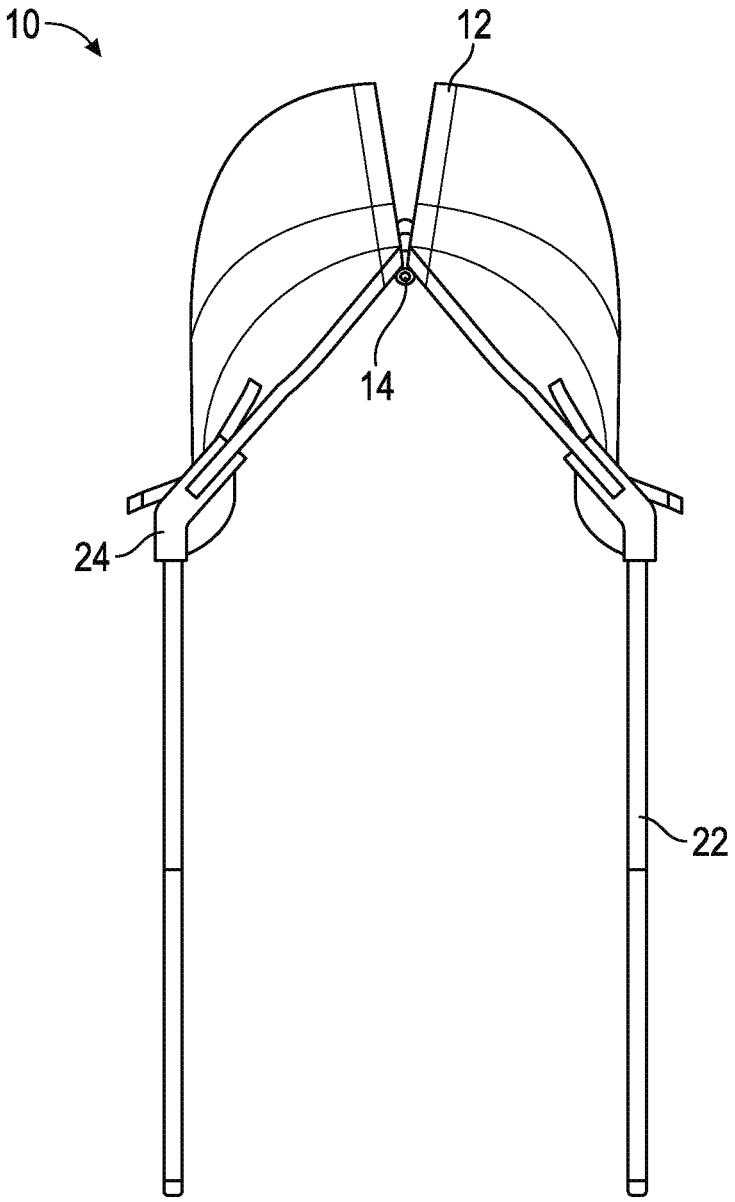

In one embodiment as best illustrated in FIGS. 8-10, legs 22 can be provided. Optionally, legs 22 can fold or otherwise retract in order to facilitate portability and to provide a reduced size for storage. Optionally, saddle seat 10 can be foldable or it can be a non-folding configuration. In the non-folding configuration, seat halves 12 can be fixedly joined together or formed from a single continuous piece of material such that they are not foldable with respect to one another. Although legs 22 can be connected to seat 10 via any known connection method, in one embodiment, leg attachment blocks 24 are preferably provided at or near the corners of base plates 18, which of course can also be a single baseplate in a non-folding embodiment. In one embodiment, legs 22 can have feet or an enlarged area on a terminal end thereof. This helps distribute the weight of the user and the seat on a larger area so that legs 22 do not sink into the ground when the ground is soft.

In a non-folding embodiment, as well as in a folding embodiment, the one or more base plates 18 need not be provided. In this embodiment, the seat halves can be formed from a rigid material which itself provides the structural support to support the weight of a user. In this embodiment, legs 22, if provided, can attach or otherwise be configured directly onto seat halves 12.

For embodiments which fold, although stop 16 is illustrated as comprising a flexible member that connects to and extends between base plates 18, any shape, size or type of a stop can be used and will provide desirable results so long as the stop prevents seat halves 12 from flattening until hinge 14 contacts a surface on which saddle seat 10 rests. For example, in one embodiment, stop 16 can be formed from a latch or catch-type mechanism. In an alternative embodiment, stop 16 can be formed simply by an upper or rear portion of seat halves 12 contacting one another (as could happen for example when the v-shaped gap between the upper rear portions of seat halves 12 of FIG. 1 close).

For embodiments of saddle seat 10 which are not foldable, stop 16 and/or hinge 14, need not be provided. In one embodiment, seat halves 12 can be rigid, flexible, or can comprise one or more padded surfaces. In one embodiment, when in use, a bottom edge of each base plate 18 preferably contacts the surface on which saddle seat 10 rests and bears the weight of the seat and the user. In this embodiment, saddle seat 10 can optionally be placed upon a bleacher and used as a bleacher seat. In one embodiment, saddle seat 10 can be folding and can have legs 22 which can optionally fold or retract out of the way so that saddle seat 10 can be used both as a stadium seat, with legs 22 in a folded or retracted position, and also used as a lawn-chair or other use when legs 22 are in an extended position.

Handles 20 can be provided or can optionally not be provided. In one embodiment, handles 20 can be provided by forming holes into base plate 18—for embodiments which comprise base plates 18. Or, for embodiments that do not comprise one or more base plates 18, handles 20 can be provided by forming holes into lower portions of seat halves 12. In one embodiment, handles 20 can be connected to base plate 18 or to seat halves 12. Optionally, handles 20 can comprise a hinge or other design which permits them to fold or swing out of the way when saddle seat 10 is opened for placement on a supporting surface.

In one embodiment, seat halves 12 preferably comprise a generally curved-shape, which, when arranged into a position for sitting thereon (such position hereinafter generally referred to as its "intended use position"), form a convex shape which is similar to that of a horse saddle. In one embodiment, when in its intended use position, a rear portion of saddle seat 10 is higher than a front portion of saddle seat 10. In one embodiment, saddle seat 10 does not comprise a seatback. In one embodiment, when disposed in its intended use position, a user sits on saddle seat 10 by passing his/her legs over opposing side-portions of seat halves 12. In one embodiment, when saddle seat 10 is in its intended use position, and a user sits on it, the user's legs do not generally drape over the front edge of saddle seat 10. Rather, the user preferably straddles saddle seat 10 when using it in its intended use position.

In one embodiment, when disposed in its intended use position, seat halves 12 are preferably not substantially flat. In one embodiment, when disposed in its intended use position, the rear portion of seat halves 12 do not lie in the same plane as the front portion of seat halves 12. In one embodiment, when in its intended use position, the rear portion of seat halves 12 are preferably not substantially perpendicular with the front portion of seat halves 12. In one embodiment, when in its intended use position, the rear portion of seat halves 12 are preferably not substantially parallel with the front portion of seat halves 12.

In one embodiment, hinge 14, if provided, can be formed from a conventional hinge or it can be formed from a flexible piece of material or any other material or structure which permits seat halves 12 to rotate at least partially with respect to one another.

Figure 11:
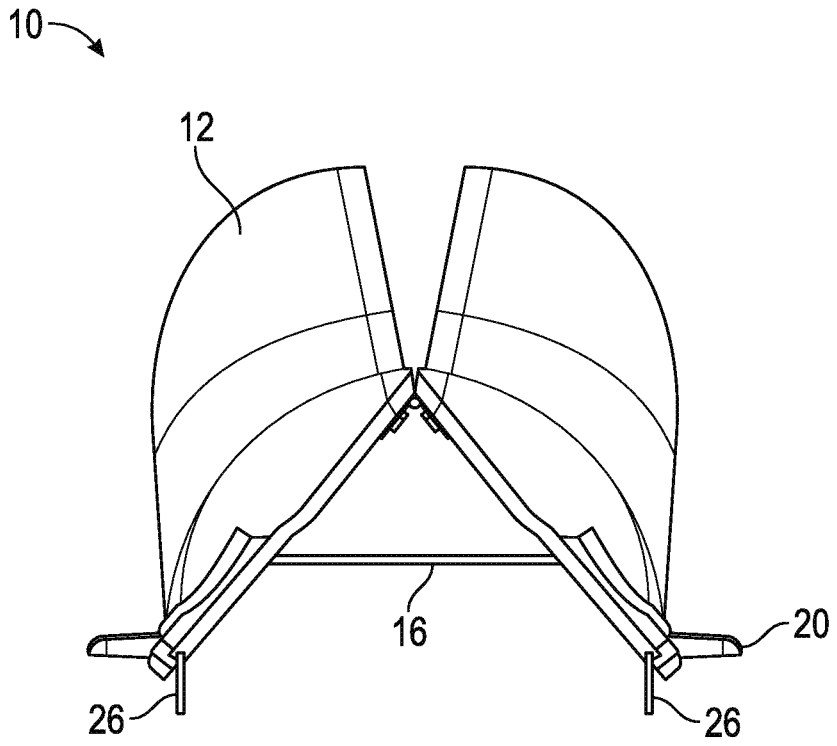
FIGS. 11 and 12, respectively, illustrate front and side views of an embodiment of the present invention wherein hooks are disposed on a lower front portion of the saddle seat.
Figure 12:
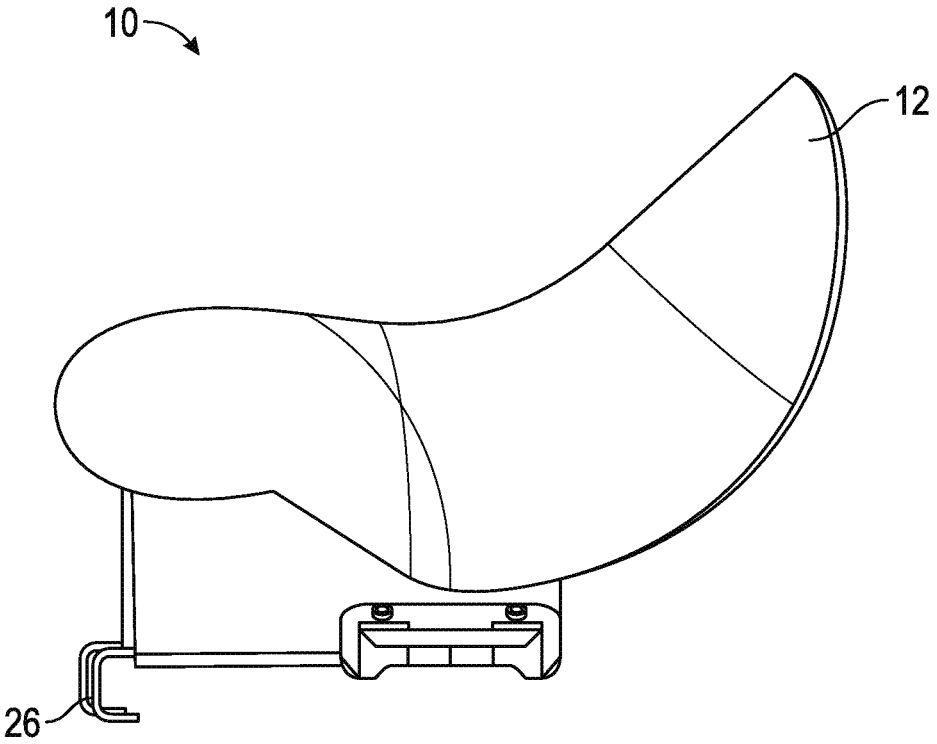
Figure 13:
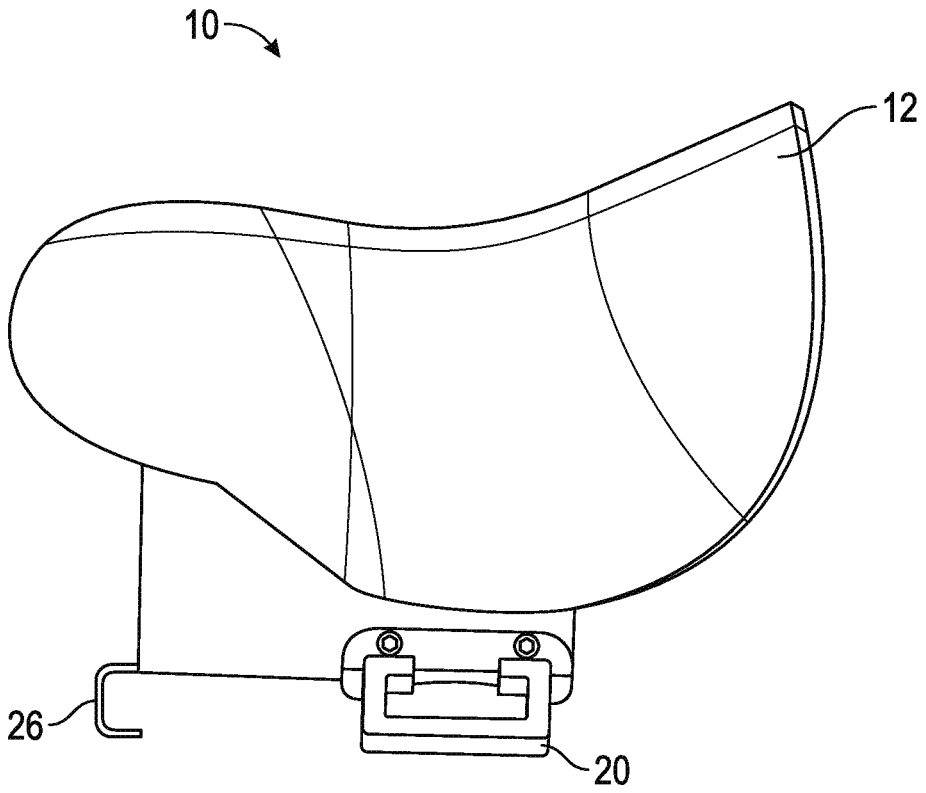
FIG. 13 is a side-view drawing of a saddle seat in a folded-closed position wherein hooks are provided on a lower front portion of the saddle seat.

Referring now to FIGS. 11-13, in one embodiment, one or more hooks 26 can be disposed on a front lower portion of saddle seat 10. In this embodiment, hooks 26 can hook onto a bleacher-type of seat or bench so that saddle seat 10 is secured thereto. In one embodiment, hooks 26 can rotate up out of the way or can slide back into saddle seat 10 so that they are out of the way when not in use.

Figure 14:
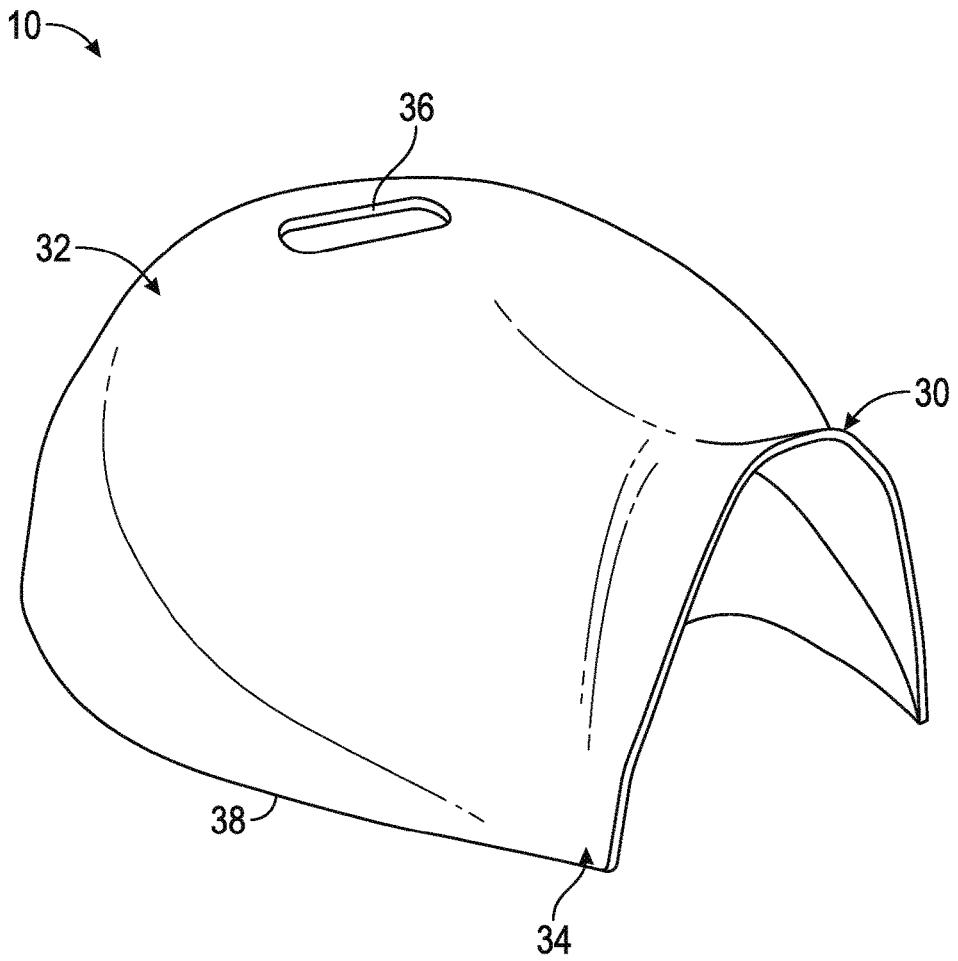
FIGS. 14, 15, and 16 are drawings of a portable saddle seat, having a handle incorporated therein, illustrated from various perspectives according to an embodiment of the present invention.
Figure 15:
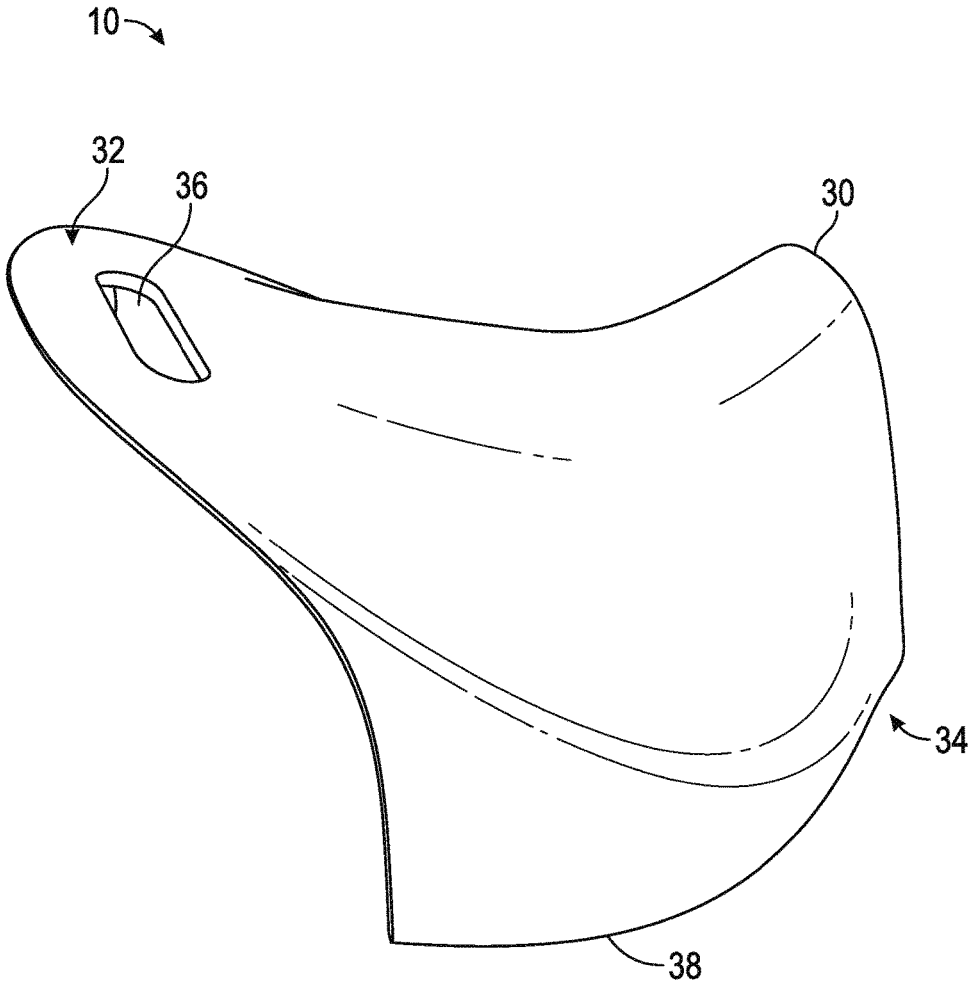
Figure 16:
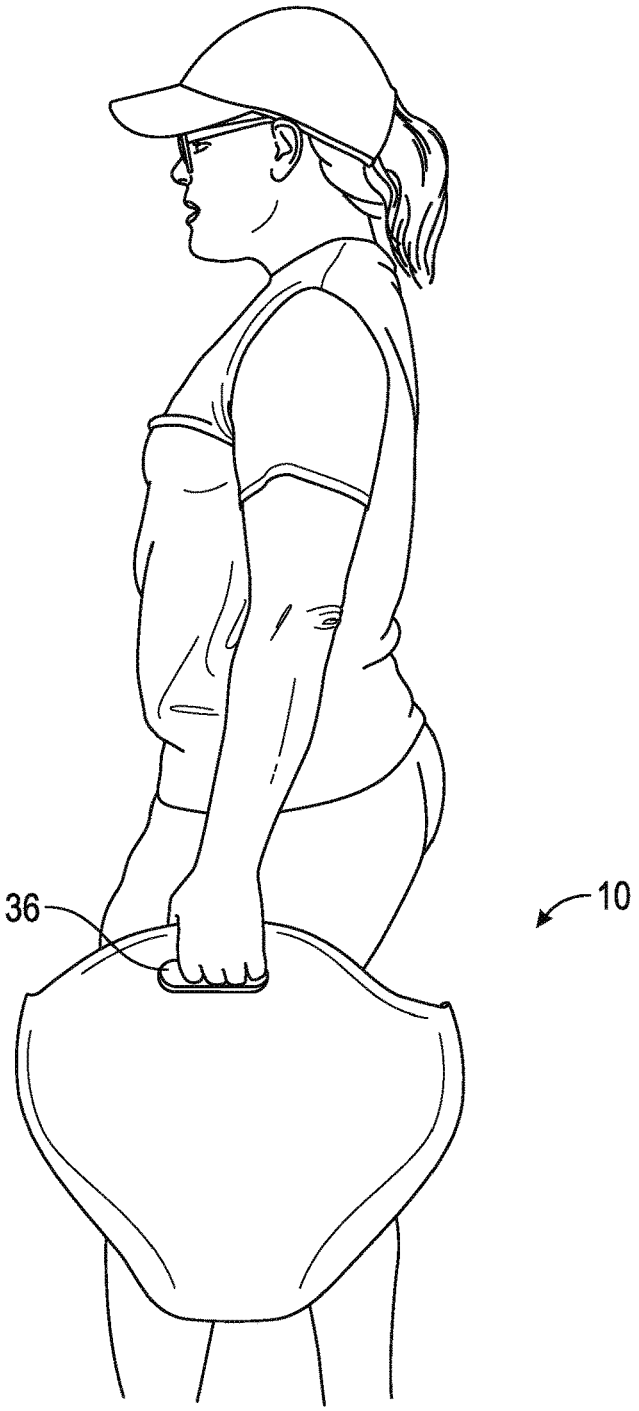

As best illustrated in FIGS. 14-16, in one embodiment, saddle seat 10 can optionally not be hinged and/or foldable. In this embodiment, saddle seat 10 can optionally be formed from a single continuous piece of material, including but not limited to a molded plastic. Optionally, of course, saddle seat 10 can be formed from a plurality of individual components that can be fastened or otherwise connected together to form a non-folding and/or non-hinging seat.

Saddle seat 10 preferably comprises raised front 30, upward-curving rear portion 32, and leg portion 34. Opening 36, which is most preferably elongated, is optionally disposed near (most preferably within about three inches) a back edge of seat 10 so that a user can insert his or her fingers or a portion of their hand therein in order to form a carrying handle. Although not essential, leg portion 34 is most preferably made more narrow than the rear-portion of saddle seat 10. In one embodiment, leg portion 34 comprises total width, from a left side of seat 10 to a right side of seat 10, which is less than or equal to about two-thirds of the widest width of seat 10.

To use the embodiment of saddle seat 10 of FIGS. 14-16, a user preferably places saddle seat 10 on a supporting surface, which can optionally be a stadium bleacher seat, bench or similar structure. The user then stands in front of raised front 30 and sits back onto the seat with his or her legs straddling raised front 30 and passing down past leg portions 34. The user's weight is thus transferred through bottom edge 38 of seat 10 onto the supporting structure.

Figure 17:
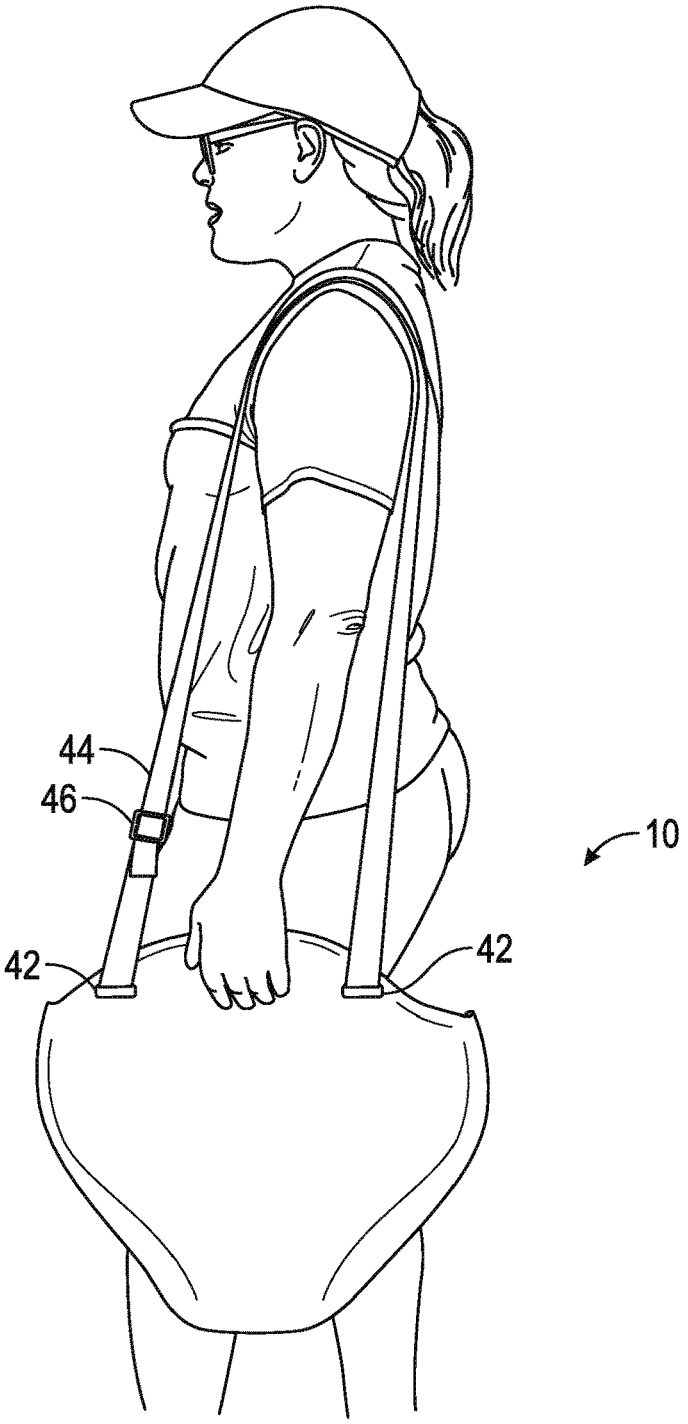
FIGS. 17 and 18 are drawings which illustrate a portable saddle seat with carrying straps attached thereto.
Figure 18:
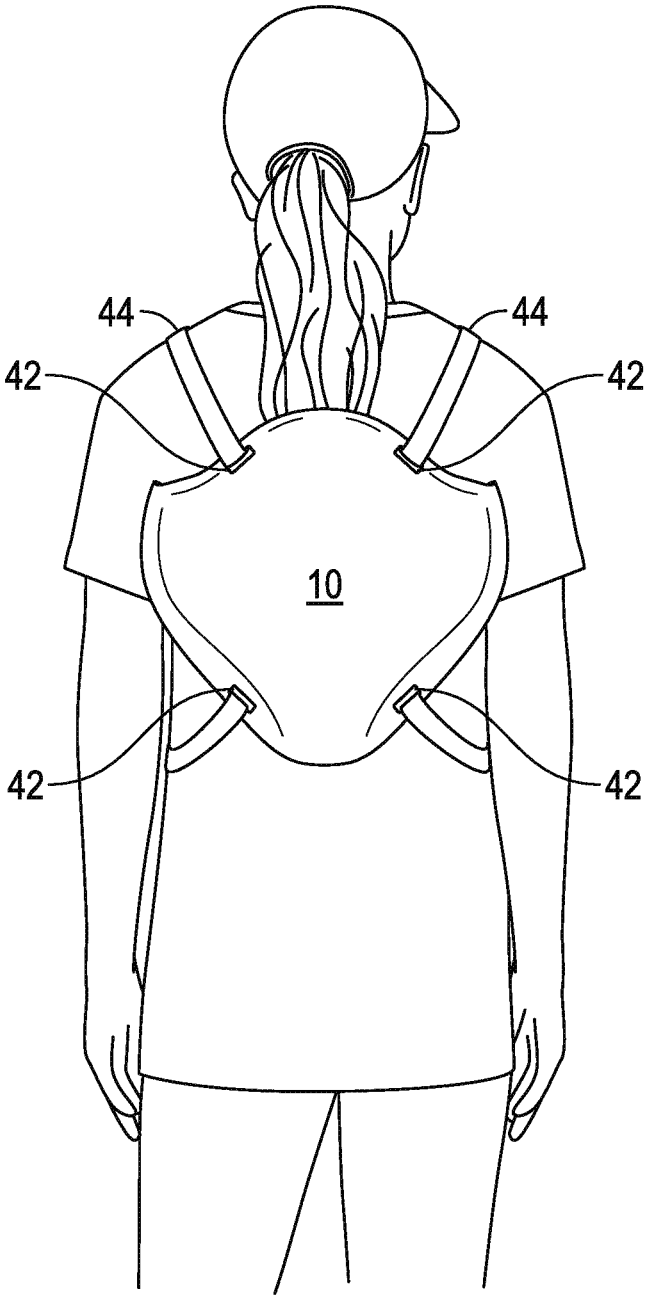

In addition to the handle that is provided by opening 36, or in lieu thereof, one or more carrying straps 44 (see FIGS. 17 and 18) can be connected to saddle seat 10. Optionally, one or more holes 42 can be disposed in seat 10 through which one or more straps 44 can pass. Optionally, one or more buckles and/or adjustment mechanisms 46 can be provided to provide length adjustment for the one or more straps 44.

Figure 19:
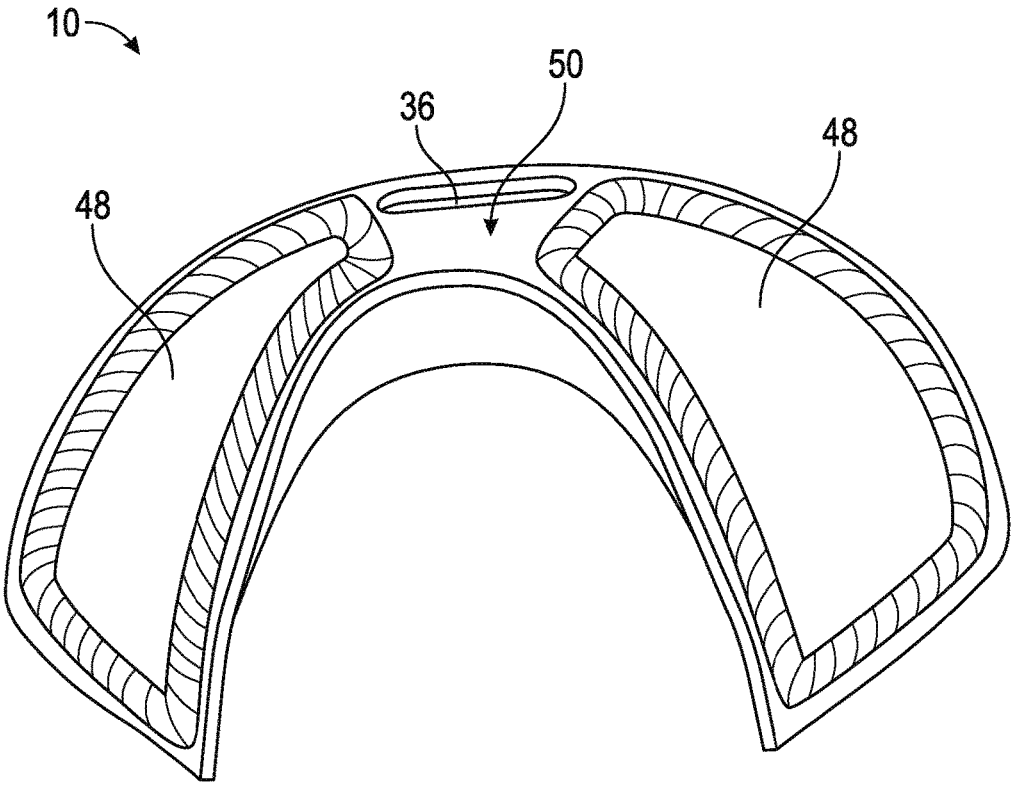
FIG. 19 is a drawing of a portable saddle seat with a padding disposed thereon.

As best illustrated in FIG. 19, one or more seat pads 48 can be disposed on, incorporated into, or otherwise attachable to seat 10. In one embodiment, seat pads 48 are preferably formed such that gap portion 50 is formed between two halves thereof and such that gap portion 50 resides along an upper central portion of seat 10. Pads 48 can be formed from any known material for forming a seat pad or seat cushion, including but not limited to cloth, foam rubber, batting, gel cushions, combinations thereof, and the like.

Figure 20:
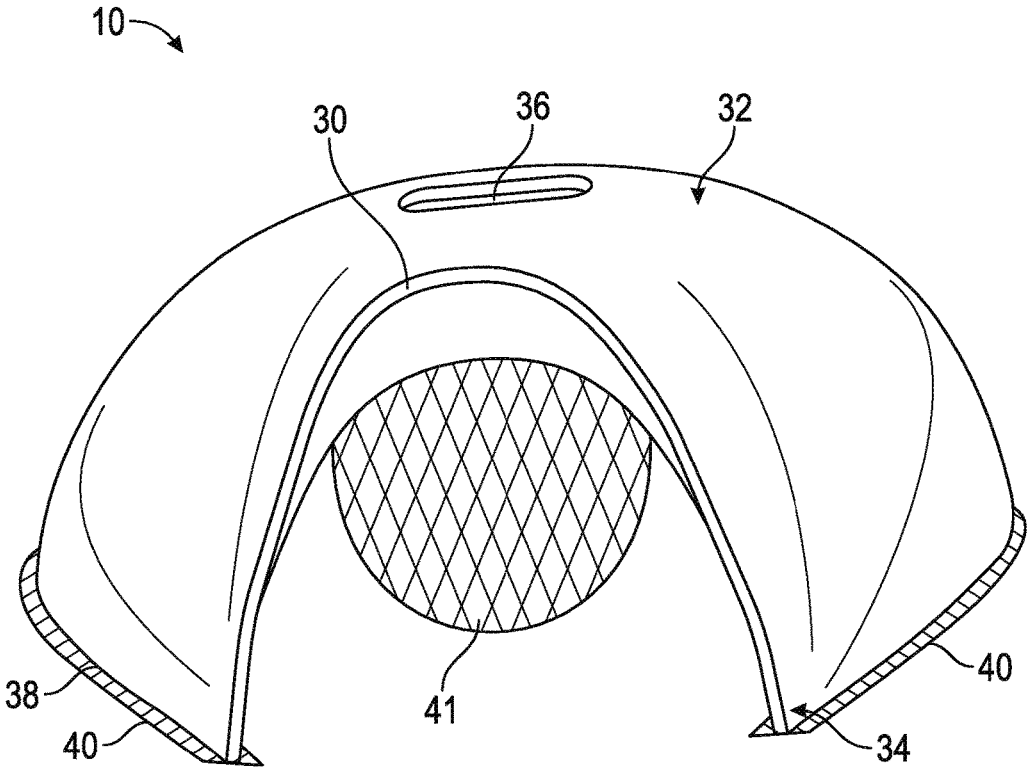
FIG. 20 is a drawing of a portable saddle seat with a non-slip material disposed on a bottom thereof and with a container disposed on an underside of the seat.

As best illustrated in FIG. 29, one or more non-slip materials 40 can be disposed along a bottom portion of seat 10 at or near bottom edge 38. Optionally, non-slip materials 40 can comprise a rubber material. In one embodiment, instead of an elongated non-slip member 40, as is illustrated in FIG. 20, a plurality of rubber feet can optionally be disposed at various locations along a bottom of saddle seat 10. In one embodiment, container 41, which can optionally be a bag or other storage container, can be attached to, disposed on, or otherwise incorporated in the recess in the bottom. In one embodiment, the bag can be formed from a mesh material and can optionally comprise a closure mechanism, which can optionally include a zipper. In one embodiment, container 41 is preferably made sufficiently large to accommodate a user's car keys and cell phone. In one embodiment, container 41 can simply comprise a shelf, which can optionally be made from a flexible material, including but not limited to netting. In this embodiment, the shelf can extend from one side of saddle seat 10 to another within the recess that is preferably formed on a bottom of saddle seat 10.

Figure 21:
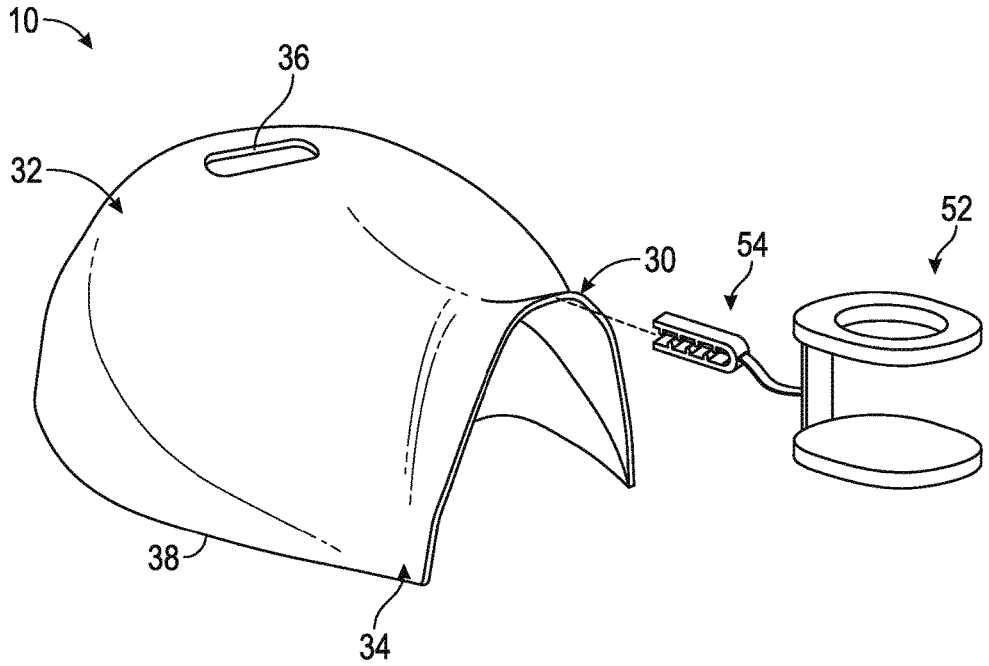
FIG. 21 is a drawing of a portable saddle seat with an attachable cup-holder.

In one embodiment, as best illustrated in FIG. 21, cup holder 52 can be attached to or otherwise incorporated into or onto saddle seat 10. In one embodiment, clip 54 can be used to attach cup holder 52 to front 30 of seat 10.

In one embodiment, saddle seat 10 does not comprise legs. In one embodiment, saddle seat 10 is not bolted or otherwise fixedly attached to a supporting structure. In one embodiment, when a user is sitting on saddle seat 10 in its intended operating position, the user's legs straddle a front portion of the seat. In one embodiment, only the outer bottom outer edge of saddle seat 10 transmits the weight of the user onto a supporting surface.

In one embodiment, the upper surface of seat 10 comprises a convex shape from its left to its right side. In one embodiment, the upper surface of seat 10 comprises a convex shape along a center portion thereof from a front to a back of seat 10. In one embodiment, the upper surface of seat 10 preferably comprises a convex shape from its left to its right, but also comprises a concave shape along its centerline from its front to its back. As such, a user's buttocks do not sit on a flat surface. In one embodiment, the portion of saddle seat 10 that lies between each of leg portions 34 is preferably convex in shape in that the portion of seat 10 between leg portions 34 preferably extends up from leg portions 34. In one embodiment, front 30 of seat 10 preferably comprises an arch shape and does not comprise a substantially flat shape.

In one embodiment, rear portion 32 of saddle seat 10 does not comprise a substantially vertical back. Instead, rear portion 32 preferably comprises a generally upward extending sloped shape which itself comprises a portion of a continuous curved upper surface of seat 10. In one embodiment, seat 10 can have a shell-like configuration such that the bottom central portion of the seat is recessed and the weight of the user and of the seat is transferred down through the outer edge of the seat. In one embodiment, the portable saddle seat has a weight of less than about ten pounds and more preferably less than about eight pounds, and most preferably less than about five pounds.

In one embodiment, the most forward portion of saddle seat 10 is front 30 and is disposed between a user's legs when in its intended operating position. In this embodiment, when a user is sitting on seat 10 in its intended operating position, no portion of seat 10 projects further forward than the portion that is between the user's legs. In one embodiment, seat 10 does not comprise legs or other downward projections. In one embodiment, seat 10 does not comprise mounts, fasteners, or a frame which extends downward from a central portion of seat 10. In one embodiment, seat 10 is formed from a rigid material that does not substantially deform when placed on a flat surface and sat on by a person. In one embodiment, the structurally supporting portion of seat 10 is not formed from a leather material. In one embodiment, seat 10 does not comprise a circular, elliptical, or oval shape when viewed from above. In one embodiment, seat 10 is not fixedly or hingedly connected to a surface on which it rests.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A portable saddle seat comprising:

a top surface having a generally concave shape along a center portion thereof from a front to a back and a generally convex shape from a left side to a right side;

a raised front;

leg portions positioned such that when a user sits on said portable saddle seat in its intended operating position, the user's legs straddle said raised front and do not drape over a front edge of said portable saddle seat;

said leg portions comprising a width that is narrower than a width of a rear portion of said portable saddle seat;

said portable saddle seat not comprising legs or mounts which extend downward from said portable saddle seat; and said portable saddle seat configured to transmit a weight of the user along an outer bottom edge thereof.

2. The portable saddle seat of claim 1 wherein said seat is formed from a single continuous piece of material.

3. The portable saddle seat of claim 1 further comprising one or more paddings disposed on a top of said portable saddle seat.

4. The portable saddle seat of claim 1 further comprising at least one handle.

5. The portable saddle seat of claim 4 wherein said handle comprises an opening through said portable saddle seat near an edge of said portable saddle seat.

6. The portable saddle seat of claim 1 wherein said handle is formed on a back portion of said portable saddle seat.

7. The portable saddle seat of claim 1 further comprising one or more carrying straps attached to said portable saddle seat.

8. The portable saddle seat of claim 7 wherein said one or more carrying straps are attached to said portable saddle seat such that said portable saddle seat can be transported on a user's back in the same manner as a backpack.

9. The portable saddle seat of claim 1 further comprising a non-slip material disposed on a bottom thereof.

10. The portable saddle seat of claim 1 further comprising a cup-holder.

11. The portable saddle seat of claim 10 wherein said cup-holder is removably positionable with respect to said portable saddle seat.

12. A portable saddle seat comprising:

a top surface having a generally concave shape along its center from a front to a back and a generally convex shape from a left side to a right side;

said portable saddle seat comprising a recessed bottom;

a raised front;

leg portions positioned such that when a user sits on said portable saddle seat in its intended operating position, the user's legs straddle said raised front and do not drape over a front edge of said portable saddle seat;

said leg portions comprising a width that is narrower than a width of a rear portion of said portable saddle seat;

said portable saddle seat not comprising legs or mounts which extend downward from said portable saddle seat; and a handle formed into said portable saddle seat by disposing an elongated opening near an edge of said portable saddle seat through which said opening a user can insert fingers and grasp said edge of said portable saddle seat.

13. The portable saddle seat of claim 12 further comprising one or more carrying straps.

14. The portable saddle seat of claim 12 further comprising a container attached to said recessed bottom of said portable saddle seat.

15. The portable saddle seat of claim 12 formed from a single continuous piece of material.

16. The portable saddle seat of claim 15 wherein said seat is formed from a molded piece of plastic material.

17. The portable saddle seat of claim 12 further comprising one or more seat cushions disposed on said portable saddle seat.

18. The portable saddle seat of claim 17 wherein said one or more seat cushions comprise two seat cushions with a gap disposed between said two seat cushions along a top central portion of said portable saddle seat.

19. The portable saddle seat of claim 12 wherein a leg portion of the portable saddle seat has a width of less than two-thirds of the overall width of the portable saddle seat.

20. A portable saddle seat comprising:

a left seat portion;

a right seat portion;

said left and right seat portions hingedly connected together;

said portable saddle seat configured such that when a user sits on said portable saddle seat in its intended operating position, the user's legs pass over said left and right seat portions and do not drape over a front edge of said portable saddle seat;

a top seat portion formed by said left and right seat portions when extended to their fully-open configuration and said top seat portion comprising a generally concave shape along its center from a front to a back and a generally convex shape from a left side to a right side; and a stop spanning between said left and right seat portions, said stop configured to prevent said left and right seat portions from flattening.

* * * * *